US011464295B2

(12) United States Patent
Clark

(10) Patent No.: US 11,464,295 B2
(45) Date of Patent: Oct. 11, 2022

(54) DECORATIVE BUTTON COVER SYSTEMS

(71) Applicant: Swittun LLC, Atlanta, GA (US)

(72) Inventor: Madison Clark, Atlanta, GA (US)

(73) Assignee: Swittun LLC, Atlanta, GA (US)

( * ) Notice: Subject to any disclaimer, the term of this patent is extended or adjusted under 35 U.S.C. 154(b) by 0 days.

(21) Appl. No.: 17/318,452

(22) Filed: May 12, 2021

(65) Prior Publication Data

US 2021/0353009 A1 Nov. 18, 2021

Related U.S. Application Data

(60) Provisional application No. 63/023,960, filed on May 13, 2020.

(51) Int. Cl.
*A44B 1/14* (2006.01)
*A44B 1/04* (2006.01)

(52) U.S. Cl.
CPC ..... *A44B 1/14* (2013.01); *A44B 1/04* (2013.01); *Y10T 24/3672* (2015.01)

(58) Field of Classification Search
CPC ..... A44B 5/007; A44B 1/04; A44B 1/14; A41D 27/08; Y10T 24/367; Y10T 24/3672
See application file for complete search history.

(56) References Cited

U.S. PATENT DOCUMENTS 1,180,104 A * 4/1916 Barnes ..... A47L 13/502 68/235 R
2,850,779 A * 9/1958 Dobro ..... A44B 1/14 40/315
3,343,230 A * 9/1967 Darvie ..... A44B 1/14 D11/95
4,471,510 A * 9/1984 DeRosa ..... A44B 1/22 24/624
D288,185 S * 2/1987 Derosa ..... D11/222
5,033,168 A * 7/1991 Sbragi ..... A44B 1/14 24/113 MP
7,228,598 B1 * 6/2007 Powers ..... A44B 1/14 24/113 R
9,198,480 B1 * 12/2015 Junge ..... A44B 1/14
(Continued)

FOREIGN PATENT DOCUMENTS

CA 2433655 A1 * 11/2004
DE 1932670 A1 * 6/1969 ..... A44B 5/007
(Continued)

OTHER PUBLICATIONS

Machine translation of WO8401698 as produced by Espacenet for EP013316A1 (Year: 2022).*
(Continued)

*Primary Examiner* — Robert Sandy
*Assistant Examiner* — Michael S Lee
(74) *Attorney, Agent, or Firm* — Troutman Pepper Hamilton Sanders LLP; Korbin M. Blunck

(57) ABSTRACT

A decorative button cover system is disclosed herein. The decorative button cover system can include a button slide portion configured to slidably receive at least a portion of a button of a garment, and the decorative button cover system can include a decorative portion attached to the button slide portion. The decorative button cover system can also include a button of a garment configured to at least partially insert into button slide.

13 Claims, 8 Drawing Sheets

(56) References Cited

U.S. PATENT DOCUMENTS

| | | | | |
|---|---|---|---|---|
| 9,307,806 | B1 * | 4/2016 | Dorman | A47G 25/92 |
| 10,578,258 | B1 * | 3/2020 | Patton | F21L 4/00 |
| D889,315 | S * | 7/2020 | Herriot | D11/222 |
| 2004/0226145 | A1 * | 11/2004 | Ouellette | A44B 1/14<br>24/113 MP |
| 2014/0068895 | A1 * | 3/2014 | Hanaoka | A44C 1/00<br>24/3.1 |

FOREIGN PATENT DOCUMENTS

| | | | | |
|---|---|---|---|---|
| DE | 1947809 | A1 * | 9/1969 | A44B 5/07 |
| EP | 0113316 | * | 7/1984 | A44B 1/14 |
| WO | WO-8401698 | A1 * | 7/1984 | A44B 1/14 |

OTHER PUBLICATIONS

Machine translation DE1932670a1 as produced by Espacenet (Year: 2022).*
Machine translation DE1947809a1 as produced by Espacenet (Year: 2022).*

* cited by examiner

DECORATIVE BUTTON COVER SYSTEMS

CROSS REFERENCE TO RELATED APPLICATION

This application claims priority to U.S. Provisional Patent Application No. 63/023,960 filed 13 May 2020, the entire contents of which is incorporated by reference as if fully set forth herein.

BACKGROUND

Buttons are often used to fasten together pieces of fabric or portions of a single fabric garment. Different types of buttons exist (e.g., for different types or styles of garment, for different types of fashion), but a user may tire of the particular button or buttons installed on a particular garment. That is, a user may desire to exchange one or more of the existing buttons on a garment for buttons of a different style, color, or other aesthetic characteristic. In some cases, the user may desire to exchange the existing button(s) only temporarily to, for example, coincide with a particular outfit. Changing or replacing buttons, however, can be cumbersome, tedious, and time-consuming. Further, changing or replacing buttons can require some amount of sewing ability that a given user may not possess.

Accordingly, there is a need for easily exchangeable button aesthetics, while minimizing or eliminating the technical ability required to exchange the button aesthetic.

SUMMARY

These and other problems may be addressed by the technology disclosed herein. The disclosed technology includes a decorative button cover system. The decorative button cover system can include a button slide portion configured to slidably receive at least a portion of an existing button of a garment, and the decorative button cover system can include a decorative portion attached to the button slide portion. The decorative button cover system can also include a button of a garment configured to at least partially insert into a button slide. For example, the decorative button cover system can include one or more buttons (e.g., modified jeans buttons, modified blazer buttons) configured to insert into, and be snugly received by, a corresponding button slide.

The disclosed technology includes a decorative button system that can include a button slider configured to slidably receive at least a portion of a button. The button slider can include a slot and a channel. The slot can be configured to receive at least a portion of the button, and the slot can include comprising an upper surface and a lower lip. At least one of the upper surface or the lower lip can include a protrusion that is configured to abut a surface of the button. The channel can extend radially inward from an outer edge of the button slider. The channel can be (i) in direct communication with the slot, and the channel can be configured to permit an attachment portion of the button to pass therethrough.

The slot of the button slider can be substantially parallel to a top surface of the button slider.

The decorative button system can include a decorative portion attached to a top surface of the button slider.

The slot can include one or more sloped walls located at a perimeter of the slot.

The one or more sloped walls can include (i) a first upper sloped wall portion extending between an upper surface of the slot and a first inner side wall portion of the slot, (ii) a first lower sloped wall portion extending between a lower lip of the slot and the first inner side wall portion of the slot, (iii) a second upper sloped wall portion extending between the upper surface of the slot and a second inner side wall portion of the slot, the second inner side wall portion being generally opposite the first inner side wall portion, and (iv) a second lower sloped wall portion extending between the lower lip of the slot and the second inner side wall portion of the slot. One, some, or all of the first inner side wall portion, the first upper sloped wall portion, the first lower sloped wall portion, the second inner side wall portion, the second upper sloped wall portion, and the second lower sloped wall portion can be curved.

The one or more sloped walls can include (i) a third upper sloped wall portion extending between the upper surface of the slot and a rear inner wall portion of the slot and (ii) a third lower sloped wall portion extending between the lower lip of the slot and the rear inner wall portion of the slot. One, some, or all of the rear inner wall portion, the third upper sloped wall portion, and the third upper sloped wall portion can be curved.

The decorative button system can include a button structure that can include a post and a flange portion. The post can have a first end and a second end. The flange portion can be connected to the second end of the post. The flange portion can include a slot that can be configured to at least partially receive the button slider.

The flange portion of the button structure can include an attachment portion configured to connect to the first end of the post of the button structure. The attachment portion can comprise a rivet or a threaded portion. The attachment portion can have a surface configured to abut a first side of a material, and the first end of the post is configured to abut a second side of the material such that, when the attachment portion is connected to the first end of the post, the button structure is attached to the material.

The button structure can include an attachment protrusion located at least partially within the slot of the flange portion. The attachment protrusion can include a stem and a disc portion. The stem can be configured to slideably insert into at least partially the channel of the button slider, and the disc portion can be configured to slideably insert into at least partially the slot of the button slider. At least one of the stem or the disc portion can be connected to a rear wall of the slot of the flange portion.

The disclosed technology includes a decorative button kit that can include a button structure, a first decorative button system, and/or a second decorative button system. The button structure can include a post and a flange portion. The post can have a first end and a second end, and the flange portion can be connected to the second end of the post. The flange portion can include a flange slot. The button structure can include an attachment protrusion that can be located at least partially within the flange slot. The attachment protrusion can include a stem and a disc portion. The stem can have a first end attached to a bottom surface of the flange slot and a second end. The disc portion can be attached to the second end of the stem. The first decorative button system can include a first button slider and a first decorative portion attached to a top surface of the first button slider. The first button slider can be configured to slidably receive at least a portion of the button structure. The first button slider can include a first slot and a first channel. The first slot can be configured to receive at least the portion of the disc portion of the attachment protrusion. The first slot can include an upper surface and a lower lip, and at least one of the upper surface or first lower lip can include a protrusion configured to abut a surface of the disc portion of the attachment protrusion. The first channel can extend radially inward from an outer edge of the first button slider. The first channel can be in direct communication with the first slot and can be configured to permit the stem of the attachment protrusion to pass therethrough. The second decorative button system can include a second button slider and a second decorative portion attached to a top surface of the second button slider. The second decorative portion can have a decorative effect that is different from a decorative effect of the first decorative portion of the first decorative button system. The second button slider can be configured to slidably receive at least a portion of the button structure. The second button slider can include a second slot and a second channel. The second slot can be configured to receive at least the portion of the disc portion of the attachment protrusion. The second slot can include an upper surface and a lower lip, and at least one of the upper surface or second lower lip can include a protrusion configured to abut a surface of the disc portion of the attachment protrusion. The second channel can extend radially inward from an outer edge of the second button slider. The second channel can be in direct communication with the second slot and can be configured to permit the stem of the attachment protrusion to pass therethrough.

The flange slot can be configured to at least partially receive the first button slider or the second button slider.

At least one of the stem of the attachment protrusion or the disc portion of the attachment protrusion can be connected to a rear wall of the flange slot of the flange portion.

The button structure can include an attachment portion configured to connect to the first end of the post. The attachment portion can include a rivet or a threaded portion.

These and other aspects of the present disclosure are described in the Detailed Description below and the accompanying figures. Other aspects and features of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various other examples of the disclosure discussed herein. In similar fashion, while examples may be discussed below as devices, systems, or methods, it is to be understood that such examples can be implemented in various devices, systems, and methods of the present disclosure.

BRIEF DESCRIPTION OF THE FIGURES

Reference will now be made to the accompanying figures, which are not necessarily drawn to scale, and wherein.

DETAILED DESCRIPTION

Figure 1:
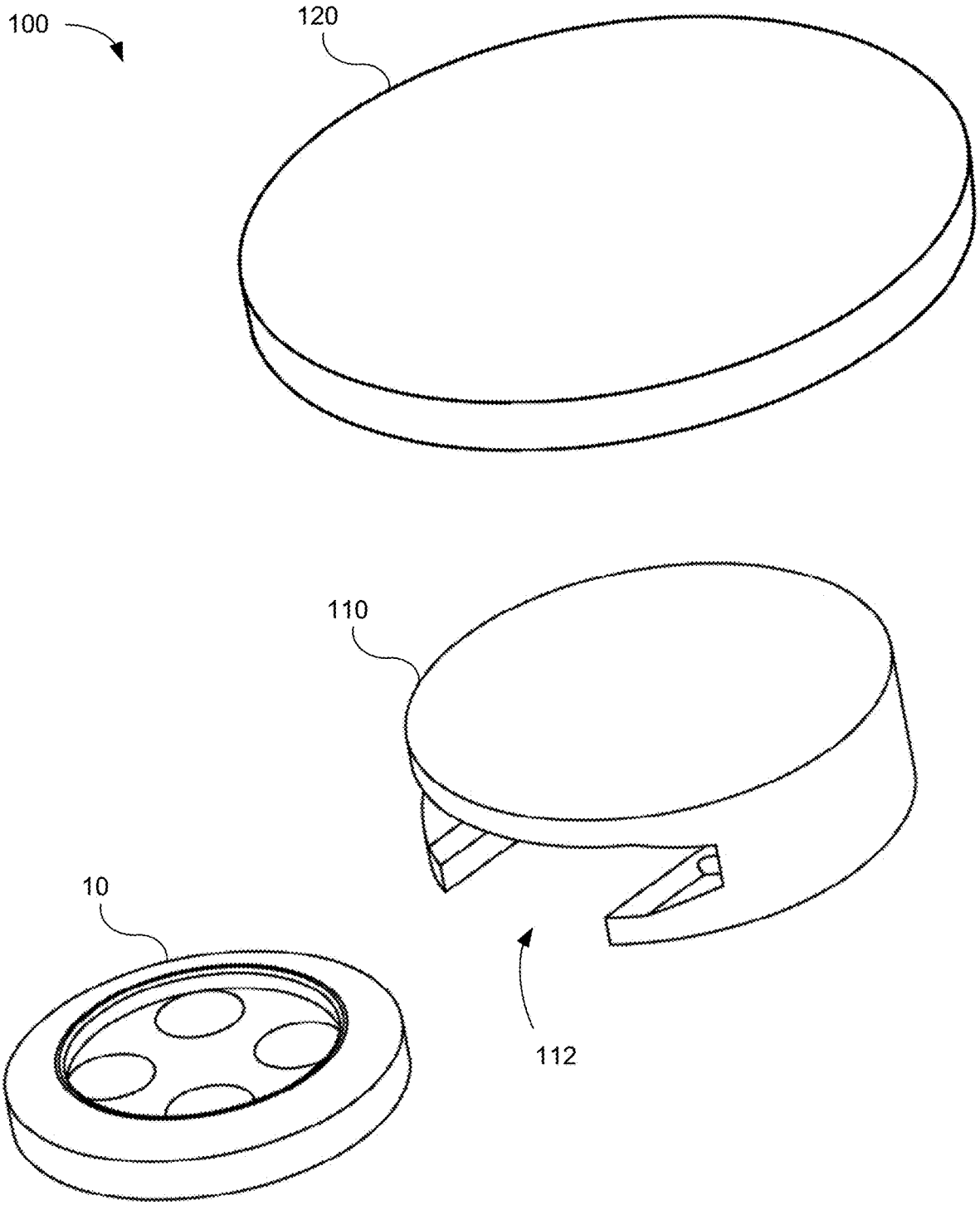
FIG. 1 illustrates an exploded view of an example decorative button system and a button, in accordance with the disclosed technology.
Figure 2A:
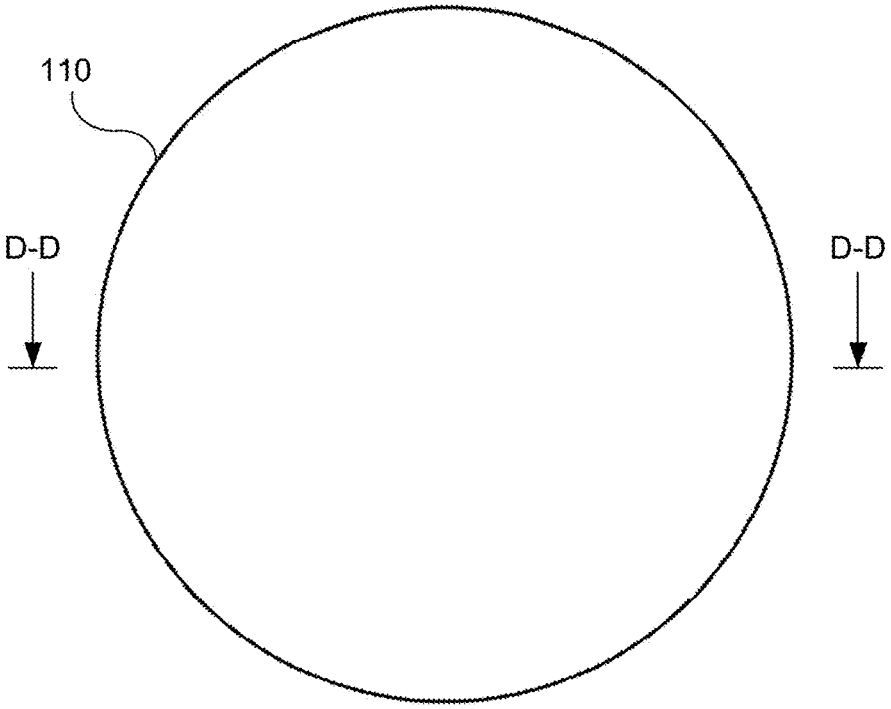
FIG. 2A illustrates a top view of an example button slide portion of an example decorative button system, in accordance with the disclosed technology.
Figure 2B:
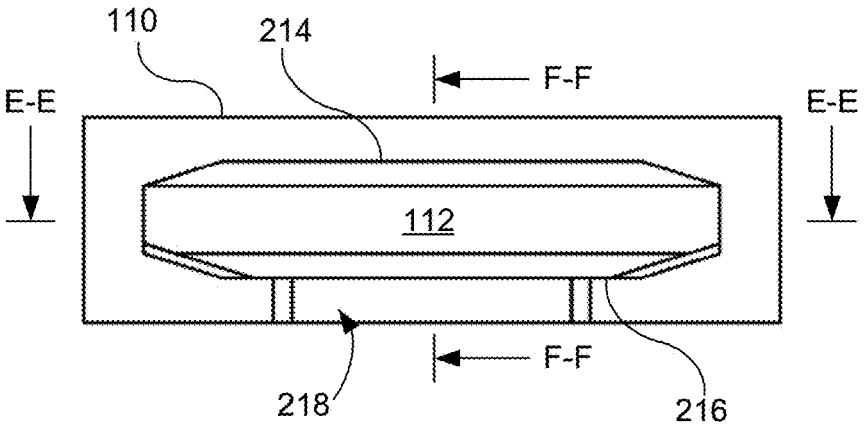
FIG. 2B illustrates a side view of an example button slide portion of an example decorative button system, in accordance with the disclosed technology.
Figure 2C:
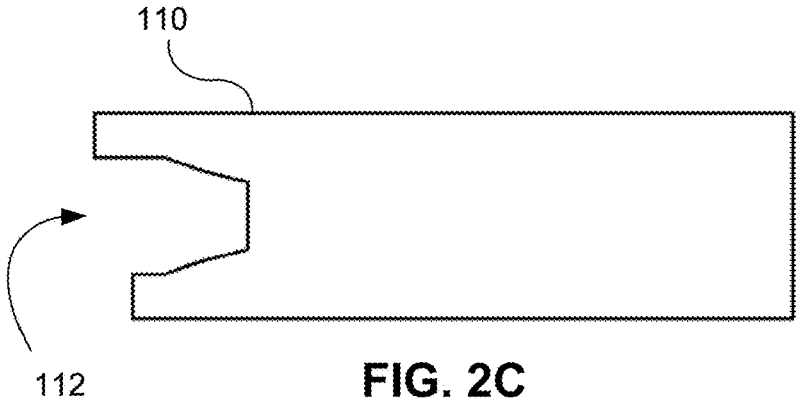
FIG. 2C illustrates a side view of an example button slide portion of an example decorative button system, in accordance with the disclosed technology.
Figure 2D:
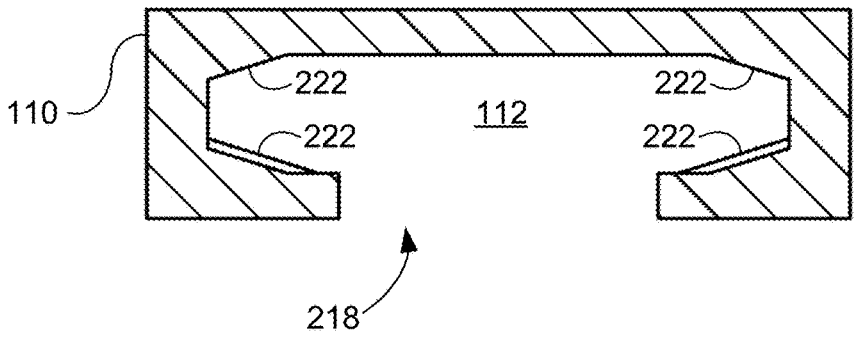
FIG. 2D illustrates a cross-sectional view taken along line D-D of FIG. 2A, in accordance with the disclosed technology.
Figure 2E:
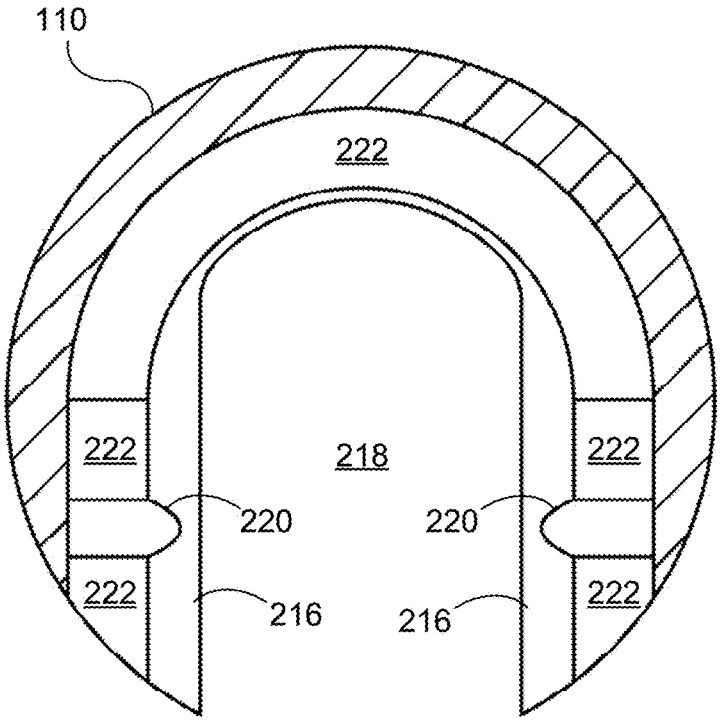
FIG. 2E illustrates a cross-sectional view taken along line E-E of FIG. 2B, in accordance with the disclosed technology.
Figure 2F:
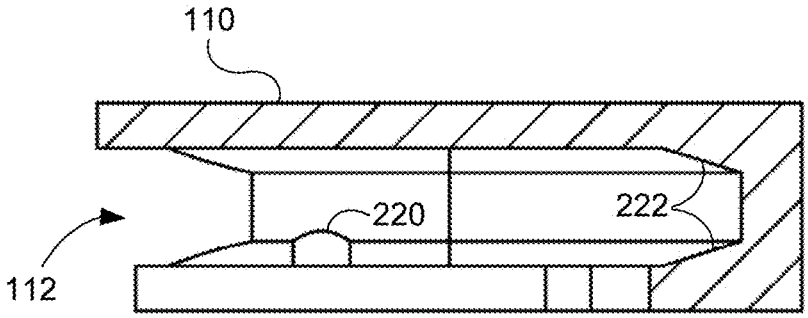
FIG. 2F illustrates a cross-sectional view taken along line F-F of FIG. 2B, in accordance with the disclosed technology.
Figure 3A:
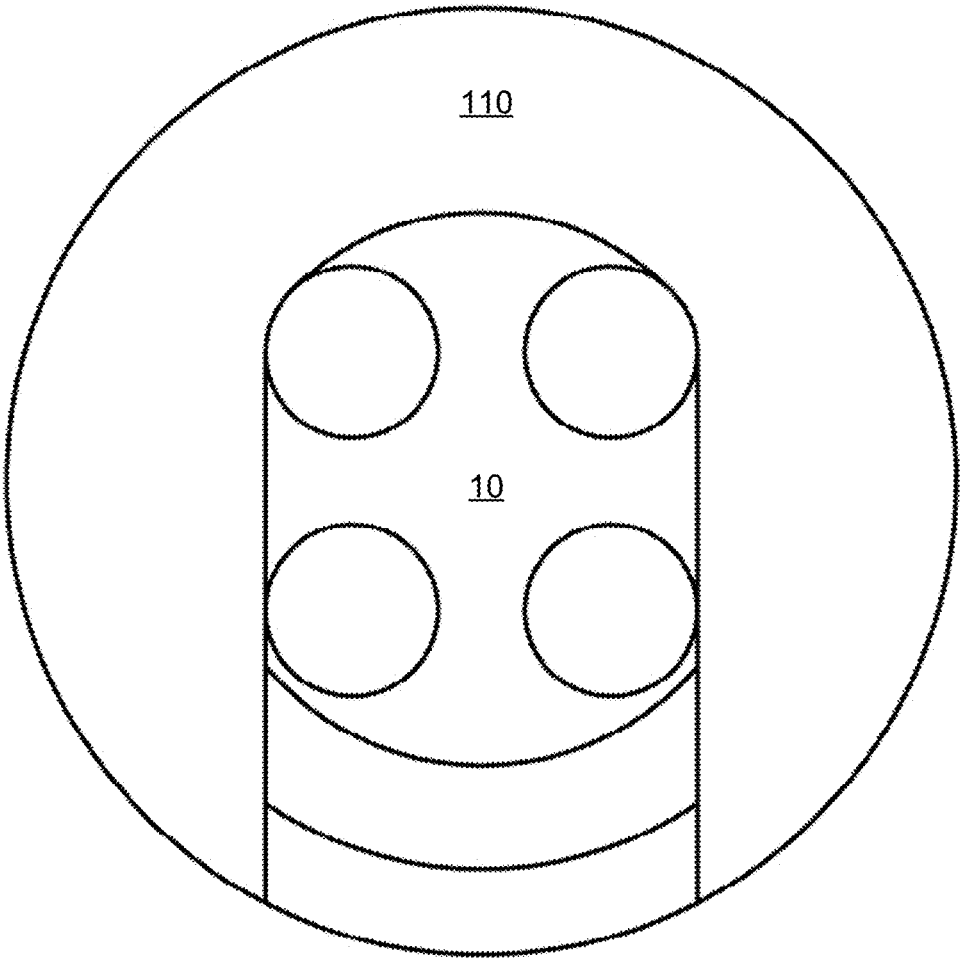
FIG. 3A illustrates a bottom view of an example button slide portion of an example decorative button system with a button disposed substantially therein, in accordance with the disclosed technology.
Figure 3B:
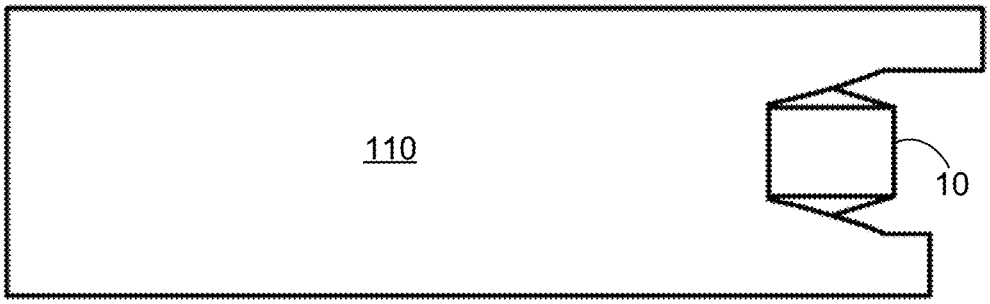
FIG. 3B illustrates a side view of an example button slide portion of an example decorative button system with a button disposed substantially therein, in accordance with the disclosed technology.
Figure 4A:
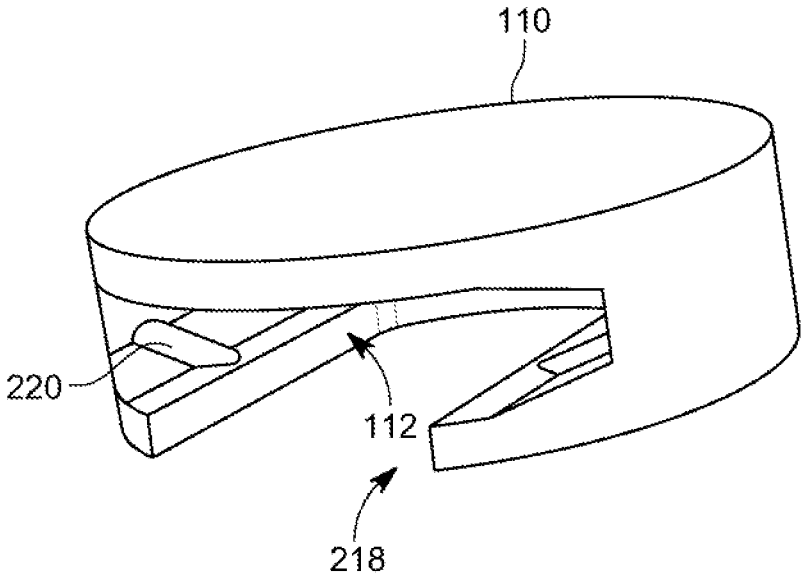
FIG. 4A illustrates a first perspective view of an example button slide, in accordance with the disclosed technology.
Figure 4B:
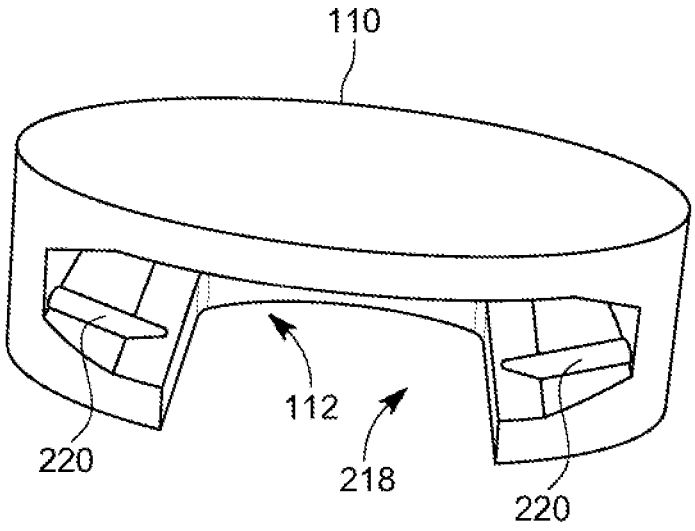
FIG. 4B illustrates a second perspective view of an example button slide, in accordance with the disclosed technology.

Throughout this disclosure, certain examples are described in relation to decorative button covers. Examples of the disclosed technology can be used in conjunction with any type of button. That is, the disclosed decorative button covers can be sized and configured to receive buttons of a particular size, shape, and/or design. For example, the disclosed decorative button covers can be used with buttons of shirts, blouses, pants (e.g., slacks, jeans), blazers, jackets, coats, or any other garment or other item including one or more buttons.

The disclosed technology will be described more fully hereinafter with reference to the accompanying drawings. This disclosed technology may, however, be embodied in many different forms and should not be construed as limited to the embodiments set forth herein. The components described hereinafter as making up various elements of the disclosed technology are intended to be illustrative and not restrictive. Many suitable components that would perform the same or similar functions as components described herein are intended to be embraced within the scope of the disclosed technology. Such other components not described herein may include, but are not limited to, for example, components developed after development of the disclosed technology.

In the following description, numerous specific details are set forth. But it is to be understood that embodiments of the disclosed technology may be practiced without these specific details. In other instances, well-known methods, structures, and techniques have not been shown in detail in order not to obscure an understanding of this description. References to "one example," "an example," "some examples," "certain examples," "various examples," "one embodiment," "an embodiment," "example embodiment," "some embodiments," "certain embodiments," "various embodiments," etc., indicate that the example(s) and/or embodiment(s) of the disclosed technology so described can include a particular feature, structure, or characteristic, but not every example and/or embodiment necessarily includes the particular feature, structure, or characteristic. Further, repeated use of the phrase "in one example" or "in one embodiment" does not necessarily refer to the same embodiment, although it may.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, any use of the ordinal adjectives "first," "second," "third," etc., to describe a common object, merely indicate that different instances of like objects are being referred to, and are not intended to imply that the objects so described should be in a given sequence, either temporally, spatially, in ranking, or in any other manner.

As explained above, the disclosed technology relates to decorative button cover systems. Referring to FIG. 1, a decorative button cover system 100 can include a button slide portion 110 and a decorative portion 120. The button slide portion 110 can be configured to attach to a button 10, and the decorative portion 120 can comprise a particular color or aesthetic design. The button slide portion 110 can include a slot 112 that is configured to receive at least a portion of a button 10. The slot 112 of the button slide portion 110 (also referred to herein as "button slider 110") can be sized and/or dimensioned to clasp onto the button 10 such that the button slide portion is removably attached onto the button 10. The decorative portion 120 can be attached to the button slide portion 110. The decorative portion 120 can be attached to the button slide portion 110 permanently. Alternatively, the decorative portion 120 can be attached to the button slide portion temporarily (e.g., removeably). The decorative portion 120 can be attached to the button slide portion 110 via an adhesive (e.g., glue, epoxy), adhesive tape, a hook-and-loop fastener, a threaded connector, other fasteners, soldering, brazing, welding, or any other attachment, connector, or fastener or related method. Alternatively, the decorative button cover system 100 can omit the decorative portion, and an upper portion and/or surface of the button slider 110 can be decorated, as a non-limiting example.

Although the button slider 110 and the decorative portion 120 are illustrated as being generally disk-like in shape, the disclosed technology is not so limited. That is, the button slider 110 and/or the decorative portion 120 can have any shape. For example, the button slider 110 and/or the decorative portion can have a cross-sectional shape that is a triangle, a square, a rectangle, a trapezoid, a pentagon, a hexagon, an octagon, any other polygonal shape, or any geometrically abnormal shape. Further, although the decorative portion 120 is illustrated as having a generally flat top surface, the decorative portion 120 can have any shape. For example, the decorative portion 120 can have a three-dimensional shape, which can include, but is not limited to, a hemispherical shape, a conical shape, or the like.

The button slider 110 can comprise any useful material. For example, the button slider 110 can comprise one or more plastics (e.g., nylon, polyethylene (PE), polypropylene (PP), polyethylene terephthalate (PET), polyvinyl chloride (PVC), acrylonitrile-butadiene-styrene (ABS)) and/or one or more metals (e.g., aluminum, copper, steel) or alloys thereof. Similarly, the decorative portion 120 can comprise one or more plastics, (e.g., nylon, PE, PP, PET, PVC, ABS), one or more metals (e.g., aluminum, copper, steel) or alloys thereof, wood, stone, gems, ceramic, glass, fabric, any other useful material(s), or any combination thereof. The decorative portion 120 can include decorations or aesthetics elements that can be provided via paint, dyes, enamel, lacquer, wood, stone, gems, ceramic, glass, fabric, one or more metals and/or alloys, one or more plastics, or the like.

Referring particularly to FIGS. 2A-2F, 4A, and 4B, the button slider 110 is described in more detail. The button slider 110 can include a slot 112 that is substantially parallel to a top face of the button slider 110. The slot 112 can be dimensioned to be receive at least a portion of a corresponding button 10. The slot 112 can include an upper surface 214 and a lower lip 216 such that, as a button 10 is slidably inserted into the slot 112, the lower lip 216 is positioned under a bottom surface of the button. Thus, the button 10 can be substantially contained within the slot 112 of the button slider 110.

The button slider 110 can include a thread channel 218 that is in communication with the slot 112, and the thread channel 218 can receive the attachment portion (e.g., attachment threads, post and rivet, threaded post and bolt) that extend between the button 10 and the respective garment or other item (thereby connecting the button 10 to the item). By so doing, the thread channel 218 can help facilitate insertion of the button 10 into the button slider 110. As will be appreciated by one of ordinary skill in the art, the thread channel 218 can be sized and/or dimensioned to receive a particular type of button. For example, the button slider 110 can be configured to receive a button attached to the garment via a post assembly, as is commonly found on jeans or other denim garments. That is, some button sliders 110 can have a comparatively small or narrow thread channel 218 configured to receive buttons attached via attachment threads, whereas other button sliders 110 can have a comparatively large or wide thread channel 218 that are configured to receive buttons attached via a post and some other attachment mechanism, such as a rivet, a screw, or the like.

The button slider 110 can include one or more protrusions 220. The protrusions 220 can be configured to abut the button 10 when the button 10 is inserted into the slot 112, and the protrusions 220 can provide frictional resistance (e.g., between the protrusion 220 and the button 10, between the button 10 and the upper surface 214 and/or the lower lip 216) to prevent the button 10 from freely sliding out of the button slider 110. Although the drawings depict protrusions 220 as protruding from the lower lip 216, the disclosed technology is not so limited. Alternatively or in addition, one or more protrusions 220 can extend from the upper surface 214. Depending on the placement of the protrusion(s) 220, the protrusion(s) 220 can abut a top surface of the button 10 and/or a bottom surface of the button 10 when the button 10 is inserted into the slot 112.

The button slider 110 can include one or more sloped walls 222. The sloped walls 222 can be disposed about some or all of the outer perimeter of the slot 112. That is, one or more sloped walls 222 can extend between the lower lip 216 and an inner side wall, and/or one or more sloped walls 22 can extend between the upper surface 214 and an inner side wall. The sloped walls 222 can provide additional contact points between the button 10 and the button slider 110 to provide frictional resistance, which can help prevent the button 10 from freely sliding out of the button slider 110.

The disclosed technology can include a set of multiple button cover systems 100. For example, a set can include a plurality of button cover systems 100, with each button cover system 100 providing a different design or aesthetic element. Accordingly, the button cover systems 100 can provide easily exchangeable button aesthetics, while eliminating any need for technical ability to exchange the button aesthetic.

Referring to FIGS. 5A-5E, the disclosed technology can include a replacement and/or modified button (e.g., a jeans button). Accordingly, the disclosed technology includes a button cover system 500, which can include a button-like structure 530 (also referred to as a "button structure") and a button slider 510. The button cover system 500 can have one, some, all, or none of the characteristics and attributes of the button cover system 100 disclosed herein. For example, the button slider 510 can have one, some, or all of the characteristics and attributes of the button slider 110.

Figure 5A:
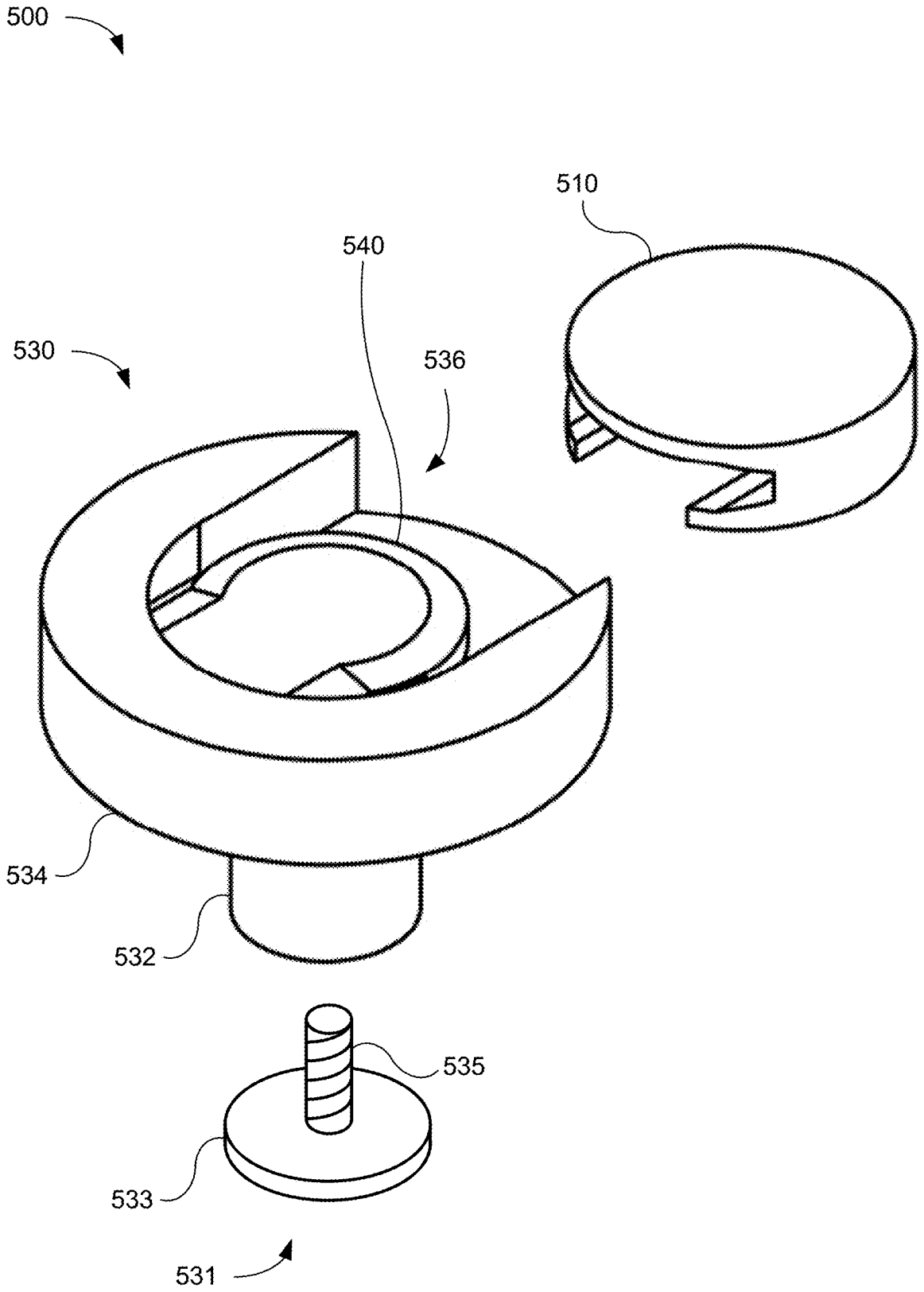
FIG. 5A illustrates an example button structure and an example button slide portion of an example decorative button system, in accordance with the disclosed technology.
Figure 5B:
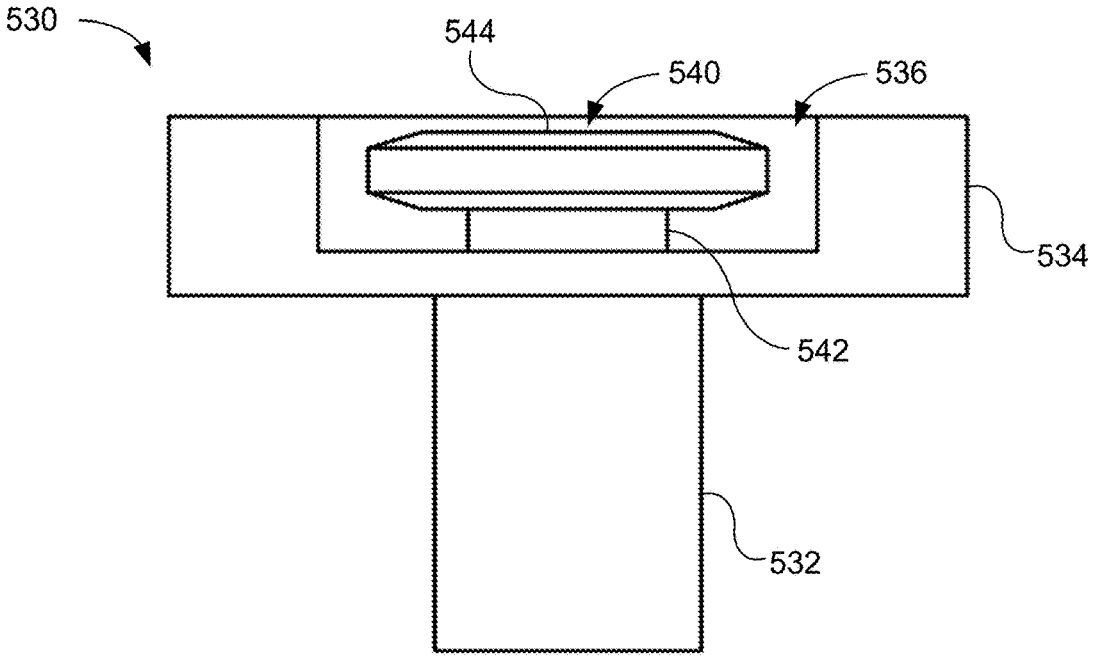
FIGS. 5B-5E illustrate a front view, a top view, a side view, and a rear view, respectively, of the example button structure shown in FIG. 5A.
Figure 5C:
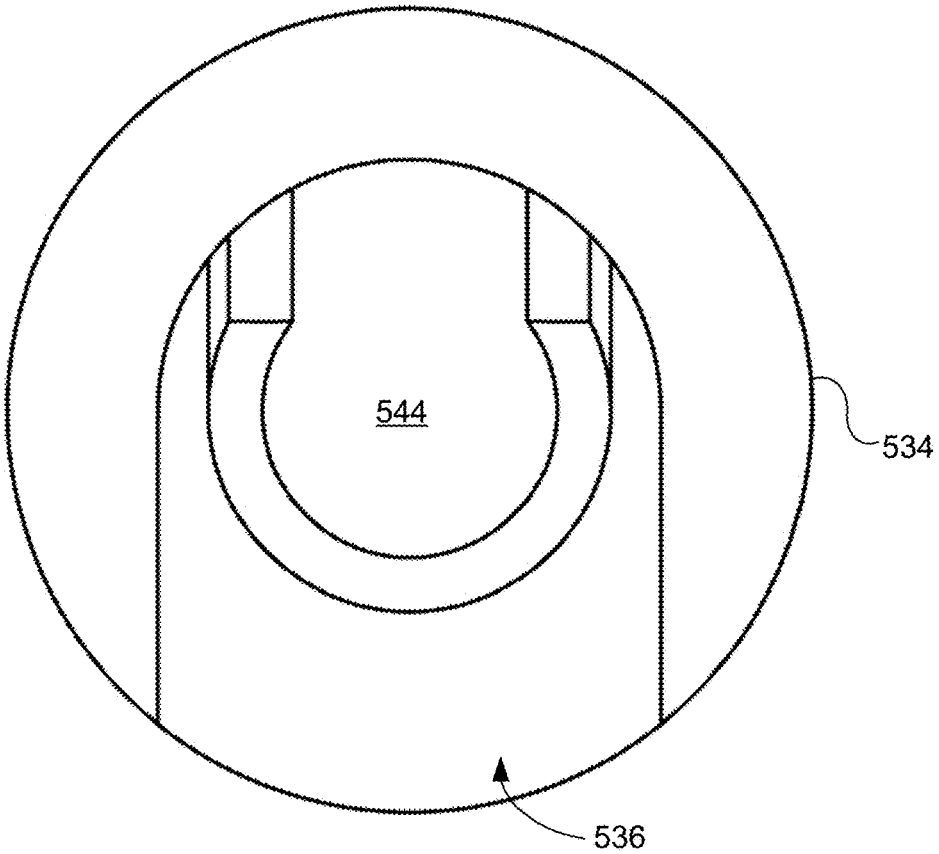
Figure 5D:
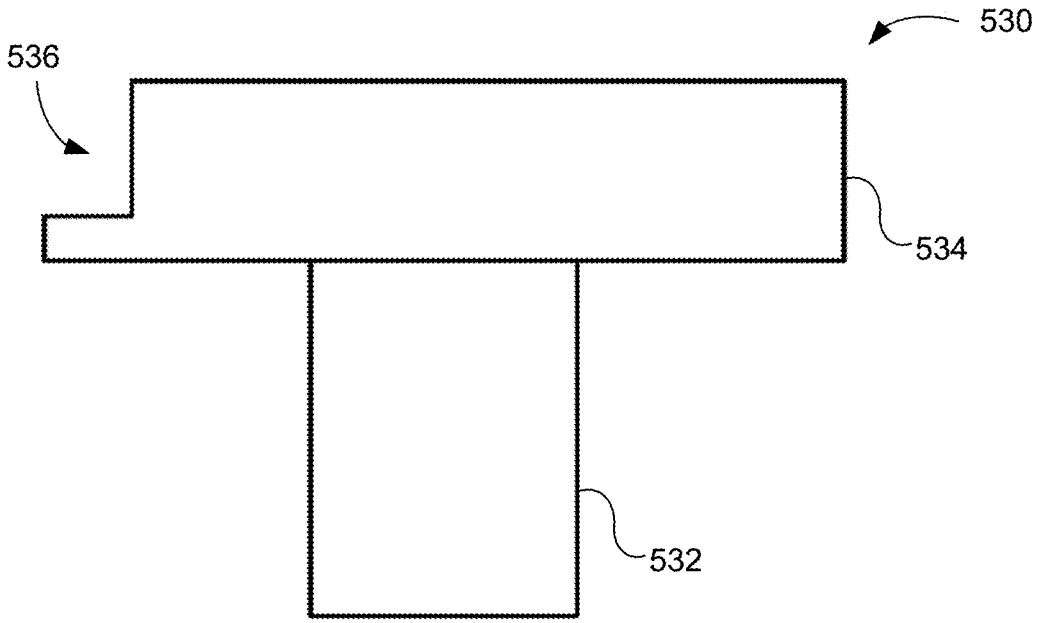
Figure 5E:
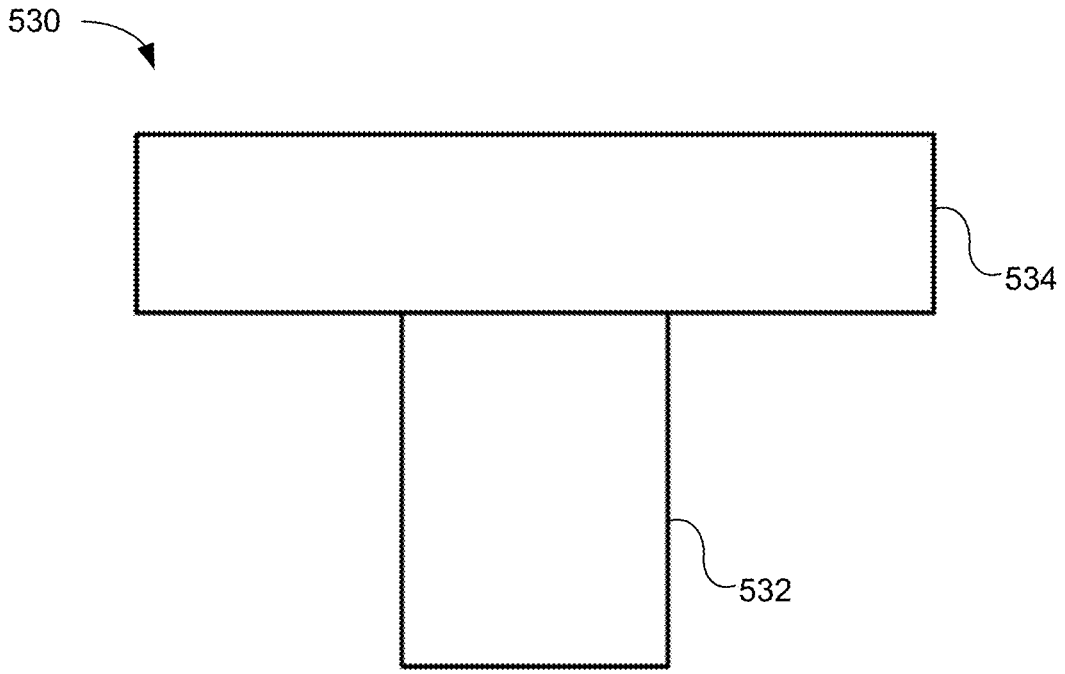

The button-like structure 530 can be configured to resemble a traditional jeans button. For example, the button-like structure 530 can include a post 532 and a flange portion 534. The button-like structure 530 can be attachable to a garment or other object. For example, the post 532 can include one or more through holes (not shown), such as at a location proximate the end of the post 532 opposite the flange portion 534, and the post 532 can thus be sewn or otherwise attached to the garment. As another example, the post 532 can be attached to the garment via a mechanical attachment portion 531. As shown in FIG. 5A, the attachment portion 531 can include a base portion 533 and a threaded portion 535. The threaded portion 535 can be configured to at least partially insert into a threaded receiving portion of the post 532. Thus, the attachment portion 531 can be detachably attachable to the post 532 of the button-like structure 530. When the attachment portion 531 is attached to the button-like structure 530, a portion of the garment or other object can be sandwiched between the base portion 533 of the attachment portion 531 and the post 532 of the button-like structure 530. Alternatively, the attachment portion 531 can be or include a rivet or other mechanical attachment system. Alternatively still, the button-like structure 530 can be attached via an adhesive, such as a glue or epoxy. Although not expressly recited herein, other attachment mechanisms, substances, and/or systems are contemplated.

The flange portion 534 can include a recess or slot 536, and the slot 536 can be configured to at least partially receive a button slider 510 (which can be the same or similar to the button slider 110 described herein). An attachment protrusion 540 can be located at least partially within the slot 536. As shown perhaps most clearly in FIGS. 5B and 5C, the attachment protrusion 540 can include a stem 542 extending upwardly away from a bottom surface of the slot 536. That is, the stem 542 can extend away from the post 532. Optionally, the stem 542 can have a diameter that is approximately equal to or greater than the width of the thread channel 218 of the button slider 110 (or the button slider 510). The flange portion 534 can have a diameter (or width if not of a cross-sectional shape) that is greater than the diameter (or width if not of a circular cross-sectional shape) of the post 532. While the flange portion 534 and post 532 are both illustrated as having generally circular cross-sectional shapes, it is to be understood that one or both can have a different cross-sectional shape, such as a square, rectangle, triangle, oval, any other polygon, or any other shape.

The attachment protrusion 540 can include a disc portion 544. The disc portion 544 can be configured to at least partially slideably insert into the slot 112 of the button slider 110 (or the button slider 510). At least some of the disc portion 544 can have a generally circular shape, but the disc portion is not required to have a generally circular shape. For example, the disc portion 544 can have a generally ovular shape or any other shape that enables the disc portion 544 to at least partially insert into, and frictionally engage, at least some of the slot 112. As shown, the disc portion 544 can include chamfered edges or corners. The disc portion 544 can be shaped and/or dimensioned to have the same or similar shape and/or dimensions of a traditional button (e.g., button 10). The disc portion 544 can thus have dimensions that are approximately equal to or less than the dimensions of the slot 112 of the button slider 110 (or the button slider 510). That is, the button slider 110, 510 can be configured to slidably receive at least a portion of the disc portion 544 (e.g., in the same way as the button slider 110 is described herein as receiving at least a portion of a button 10).

The attachment protrusion 540 can be free standing (e.g., at a generally central location within the slot 536. Alternatively, at least some of the attachment protrusion 540 can be attached to, or connected to, or abutting the flange portion 534. For example, the stem 542 and/or the disc portion 544 can extend rearwardly (e.g., away from the opening of the slot 536) toward a rear wall of the slot 536. Optionally, the stem 542 and/or disc portion 544 can be attached to or connected to the rear wall of the slot 536. This can help provide added strength and stability to the attachment protrusion 540.

While the disclosed technology has been generally described herein as being attached to, or attachable to, a garment, it is to be understood that the disclosed technology is not so limited. For example, the disclosed technology can be attached to, or attachable (detachably or permanently) to a shoe, a bag (e.g., a purse, a backpack, a suitcase), a hat, and the like.

While certain embodiments of the disclosed technology have been described in connection with what is presently considered to be the most practical embodiments, it is to be understood that the disclosed technology is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

What is claimed is:

1. A decorative button system comprising:

a button slider configured to slidably receive at least a portion of a button, the button slider comprising:

a slot configured to receive at least the portion of the button, the slot comprising an upper surface and a lower lip, wherein at least one of the upper surface or the lower lip comprises a protrusion configured to abut a surface of the button; and a channel extending radially inward from an outer edge of the button slider, the channel being (i) in direct communication with the slot and (ii) configured to permit an attachment portion of the button to pass therethrough, wherein the slot further comprises one or more sloped walls located at a perimeter of the slot, the one or more sloped walls comprising:

a first upper sloped wall portion extending between an upper surface of the slot and a first inner side wall portion of the slot;

a first lower sloped wall portion extending between a lower lip of the slot and the first inner side wall portion of the slot;

a second upper sloped wall portion extending between the upper surface of the slot and a second inner side wall portion of the slot, the second inner side wall portion being generally opposite the first inner side wall portion; and a second lower sloped wall portion extending between the lower lip of the slot and the second inner side wall portion of the slot.

2. The decorative button system of claim 1, wherein the slot of the button slider is substantially parallel to a top surface of the button slider.

3. The decorative button system of claim 1 further comprising a decorative portion attached to a top surface of the button slider.

4. The decorative button system of claim 1, wherein the first inner side wall portion, the first upper sloped wall portion, the first lower sloped wall portion, the second inner side wall portion, the second upper sloped wall portion, and the second lower sloped wall portion are each curved.

5. The decorative button system of claim 1, wherein the one or more sloped walls further comprise:

a third upper sloped wall portion extending between the upper surface of the slot and a rear inner wall portion of the slot; and a third lower sloped wall portion extending between the lower lip of the slot and the rear inner wall portion of the slot.

6. The decorative button system of claim 5, wherein the rear inner wall portion, the third upper sloped wall portion, and the third upper sloped wall portion are each curved.

7. The decorative button system of claim 1 further comprising:

a button structure comprising:

a post having a first end and a second end; and a flange portion connected to the second end of the post, the flange portion comprising:

a slot configured to at least partially receive the button slider.

8. The decorative button system of claim 7, wherein the flange portion of the button structure further comprises:

an attachment portion configured to connect to the first end of the post of the button structure.

9. The decorative button system of claim 8, wherein the attachment portion comprises a rivet or a threaded portion.

10. The decorative button system of claim 8, wherein the attachment portion has a surface configured to abut a first side of a material and the first end of the post is configured to abut a second side of the material such that, when the attachment portion is connected to the first end of the post, the button structure is attached to the material.

11. The decorative button system of claim 7, wherein the button structure further comprises:

an attachment protrusion located at least partially within the slot of the flange portion.

12. The decorative button system of claim 11, wherein the attachment protrusion comprises:

a stem configured to slideably insert into at least partially the channel of the button slider; and a disc portion configured to slideably insert into at least partially the slot of the button slider.

13. The decorative button system of claim 12, wherein at least one of the stem or the disc portion is connected to a rear wall of the slot of the flange portion.

* * * * *